United States Patent [19]

Kulesza et al.

[11] 4,246,719

[45] Jan. 27, 1981

[54] FLUID ACTUATED TOY

[75] Inventors: Ralph J. Kulesza, Chicago; Palmer J. Schoenfield, Evanston; Harry Disko, South Barrington, all of Ill.

[73] Assignee: Marvin Glass & Associates, Chicago, Ill.

[21] Appl. No.: 106,152

[22] Filed: Dec. 21, 1979

[51] Int. Cl.[3] ..... A63H 29/14; A63H 23/10

[52] U.S. Cl. ..... 46/41; 46/92; 46/145

[58] Field of Search ..... 46/41, 42, 91, 92, 145, 46/146

[56] References Cited

U.S. PATENT DOCUMENTS

| | | | |
|---|---|---|---|
| 1,425,865 | 8/1922 | Kehl | 46/41 |
| 1,591,521 | 7/1926 | Esser | 46/145 |
| 2,852,884 | 9/1958 | Burt | 46/92 |

FOREIGN PATENT DOCUMENTS

| | | | |
|---|---|---|---|
| 1195 | of 1927 | Australia | 46/41 |

*Primary Examiner*—F. Barry Shay

*Attorney, Agent, or Firm*—Mason, Kolehmainen, Rathburn & Wyss

[57] ABSTRACT

A fluid actuated toy includes a housing with a fluid inlet and outlet and a fluid container pivotally mounted within the housing. A biased pop-up member is slidably mounted within the housing and includes an element for engaging an extension on the fluid container while the pop-up member is in a locked position. The toy further includes a biasing member urging the fluid container to a first position from which the container moves and releases the pop-up member upon accumulation of a predetermined amount of fluid. A platform is pivotally mounted on the housing to be engaged by the pop-up member and a figurine is removably mounted on the platform so as to be ejected upon the impact of the platform member by the pop-up member.

10 Claims, 7 Drawing Figures

Fig 4
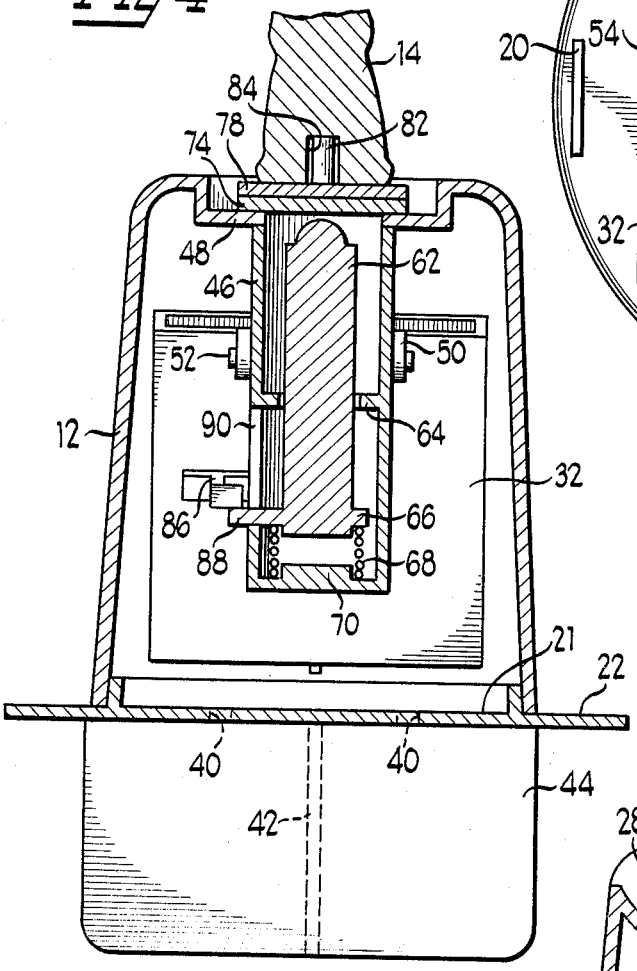
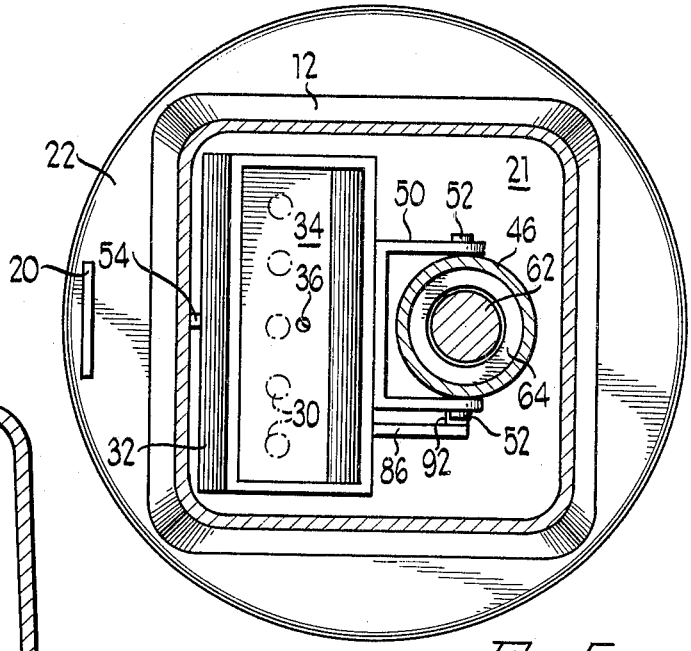
Fig 5
Fig 6
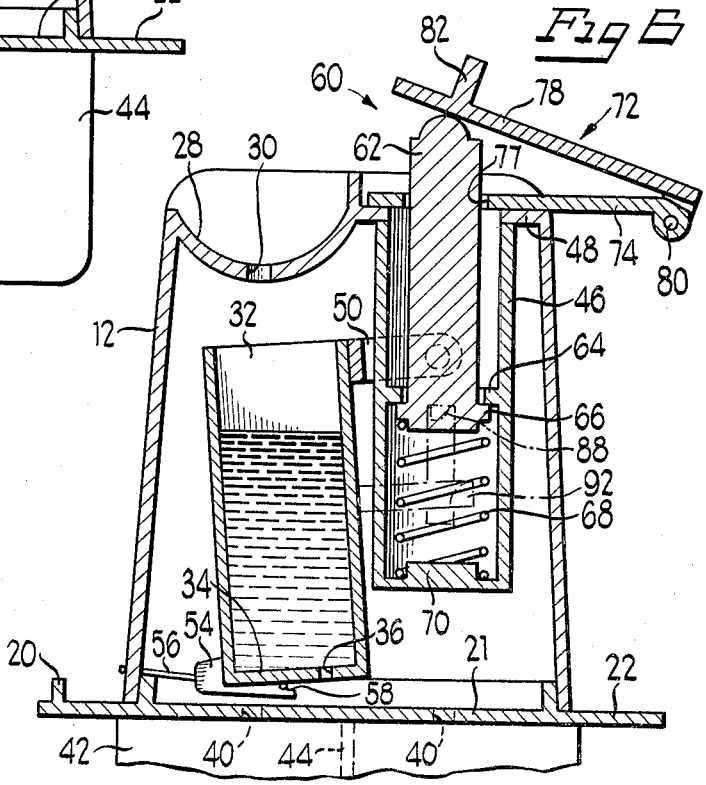
Fig 7
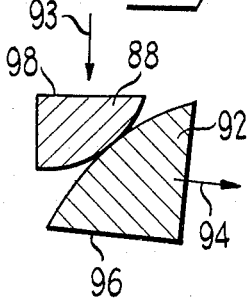

FLUID ACTUATED TOY

BACKGROUND OF THE INVENTION

1. Field of the Invention

The present invention relates to water toys and in particular to a new and improved fluid actuated toy.

2. Brief Description of the Prior Art

Younger children often enjoy being entertained while taking a bath, in a wading pool or the like. To meet these needs, many different types of floating toys and toys operated by water are available; however, most of these prior art toys lack sufficient action to maintain a young child's interest for a long period of time.

A typical prior art toy is the type such as a boat that merely floats on the water. Other prior art toys are of the wind-up type that include feet or paddles that are rotated after being wound up and paddle the toy through the water providing some action.

Although some action is involved in both of these toys, they do not require action on the part of the child to make them operate and thus do not provide a learning experience. Accordingly, it is desirable to provide a floating action toy that can be operated by a child to provide both entertainment and a learning experience.

SUMMARY OF THE INVENTION

An object of the present invention is to provide a new and improved floating toy.

A further object of the present invention is to provide a new and improved fluid actuated toy.

Still another object of the present invention is to provide a new and improved floating toy that is fluid actuated upon operation by a small child or the like.

The present invention is directed to a new and improved fluid actuated toy that is intended to eject an object such as a figurine from the toy and thereafter the figurine may be recovered and placed in a boat or the like. The toy includes a hollow housing with a fluid inlet and outlet. A fluid container is pivotally mounted within the housing and includes an inlet and outlet communication with the fluid inlet and outlet, respectively, of the housing. The fluid container is pivotally mounted within the housing and biased to a first position by a biasing member. The fluid container pivots to a second position upon accumulation of a predetermined amount of fluid.

Upon pivoting to a second position, the fluid container releases a pop-up member that is slidably mounted within the housing and biased to a position extending outwardly of the housing by a spring. The pop-up member includes a member that engages an extension on the fluid container to lock the pop-up member in a first, down position. Upon pivoting of the fluid container to the second position, the extension and member are disengaged releasing the pop-up member to a second position (the release position) under the influence of the spring. Upon reaching this second position, the pop-up member engages a platform pivotally mounted to the housing of the toy pivoting it upwardly. An object such as the figurine is releasably secured to the platform and upon the platform being pivoted by the pop-up member, is propelled from the platform upwardly and away from the toy.

In the preferred embodiment, the toy includes a removable annular float to allow the toy to float in a body of water. Also included is a boat such that the figurine, upon being propelled from the platform, lands in the body of water and the child operating the toy may then place the figurine in the boat.

As can be understood, the toy of the present invention not only floats but also provides entertaining action for the child operating the toy. In addition, the toy of the present invention requires that the child fill the fluid container with a predetermined amount of fluid in order to commence the action of the toy thus providing a learning experience for the child.

BRIEF DESCRIPTION OF THE DRAWINGS

The above and other objects and advantages and novel features of the present invention will become apparent from the following detailed description of the preferred embodiment of the invention illustrated in the accompanying drawings wherein:

FIG. 4 is another vertical section taken generally along line 4—4 of FIG. 3;

FIG. 5 is a horizontal section taken generally along line 5—5 of FIG. 3;

FIG. 6 is a view similar to FIG. 3 with a pop-up member in its upward position; and FIG. 7 is an enlarged view of the engagement of the extensions of the fluid container and pop-up member.

DESCRIPTION OF THE PREFERRED EMBODIMENT

Figure 1:
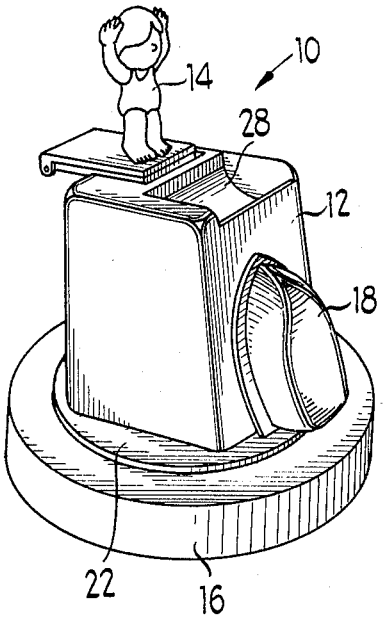
FIG. 1 is a perspective view of the assembled toy constructed in accordance with the principles of the present invention.
Figure 2:
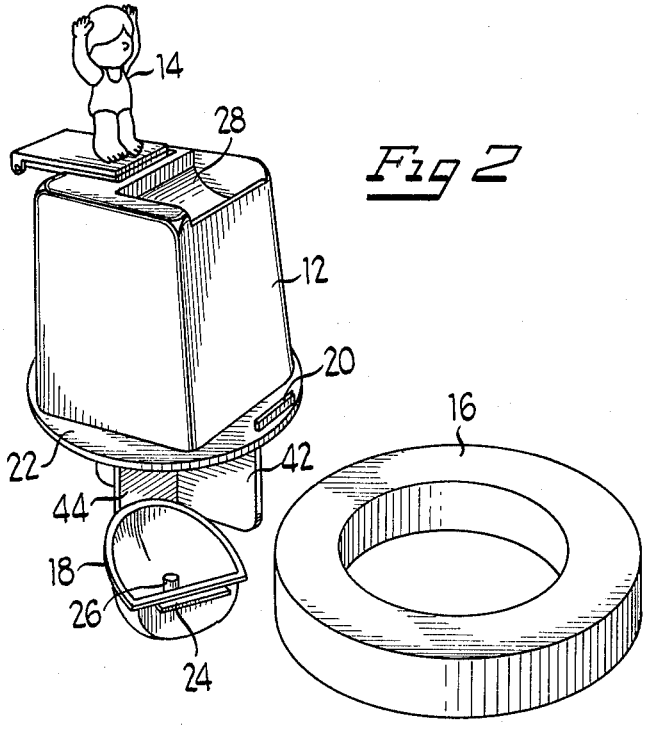
FIG. 2 is a view similar to FIG. 1 with the various components removed from the toy of FIG. 1.

Having reference now to the drawings and initially to FIGS. 1 and 2, there is illustrated a fluid actuated toy generally designated by the reference numeral 10 constructed in accordance with the principles of the present invention. The fluid actuated toy 10 is intended to provide educational, entertaining action for a child operating the toy 10 and will float on a body of water.

The toy 10 has four separable components. The first is the main toy housing 12, on which is removably mounted a second component or figurine 14 that is removably attached to the housing 12 and intended to be ejected from the toy 10 into a surrounding body of water. The third component is an annular float 16 that may be of a hollow rectangular configuration which may be used around the housing 12 to allow it to float in a body of water. The fourth component is a boat 18 that may be stabilized on the housing 12 by the engagement of a rib 20 defined on a circular bottom flange 22 on the housing 12 with a lip 24 defined on the back of a boat 18 as illustrated in FIG. 1. The boat 18 also may be removed from the housing 12 and floated on the surface of the water. The boat 18 includes a central tubular pedestal 26 on which the figurine 14 may be positioned after being ejected or launched from the housing 12.

The toy 10 is intended to operate in a manner similar to a jack-in-the-box. To obtain this action, the child operating the toy 10 may pour a predetermined amount of fluid, such as water, into the housing 12, whereupon the figurine 14 is ejected from the housing 12. The housing 12 includes, at the top, a trough 28 into which fluid, such as water, is to be poured. The trough 28 includes a plurality of bottom apertures 30 through which the water will escape. Pivotally mounted immediately below the fluid apertures 30 is a rectangular fluid container 32 that is open at the top and closed at the bottom 34 except for a single outlet aperture 36. Accordingly, fluid poured into the trough 28 flows through the apertures 30 into the container 32. As can be understood, the volume of fluid passing through the plurality of apertures 30 is greater than that released through the aperture 36. Consequently, there is an accumulation of fluid within the container 32.

Figure 3:
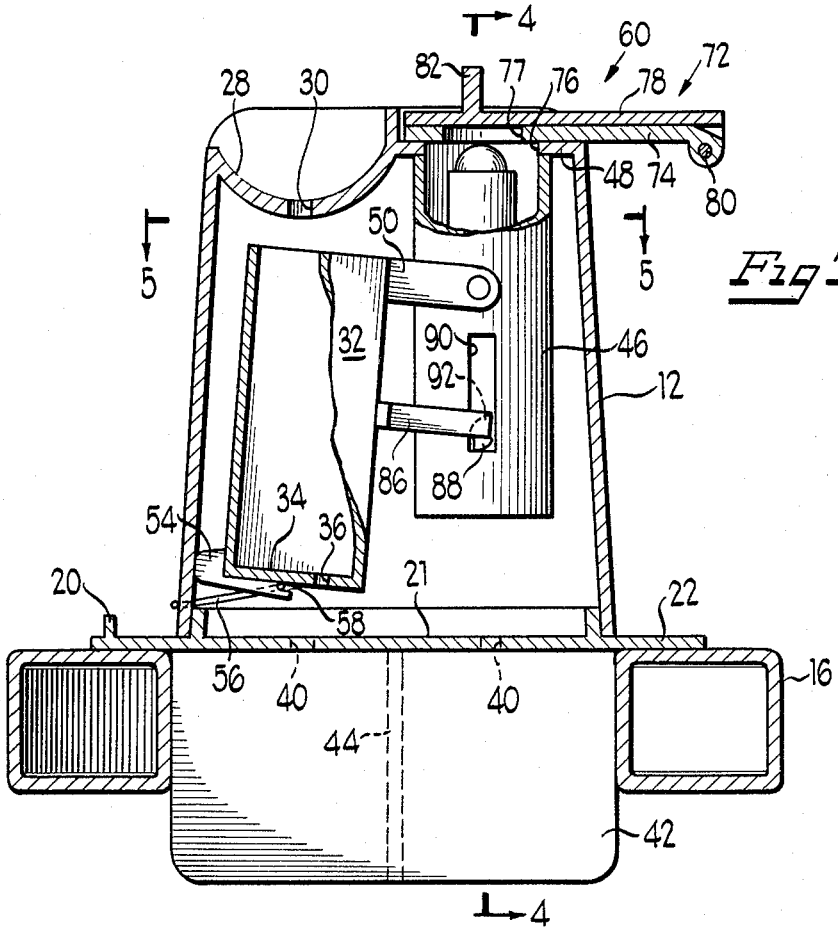
FIG. 3 is an enlarged vertical cross-sectional view of the toy of FIG. 1.

As best seen in FIG. 3, the housing 12 is hollow being closed by a bottom wall 21 and an outwardly extending peripheral flange 22. The bottom wall 21 includes a plurality of apertures 40 through which fluid from the container 22 drains. A flotation ring 16 will support the flange 22 and thus the housing 12. A pair of downwardly directed extensions 42 and 44 extending from the bottom wall 21 locates the same within the ring 16.

A cylindrical housing 46 is secured within the housing 12 to a top flange 48 that defines a portion of the top of the housing 12. The fluid container 32 includes a clevis 50 that is pivotally secured to the housing 46 by attachment to integral pegs or pivot pins 52 defined on the side of the housing 46.

The container 32 also includes a bottom flange or abutment member 54 defined on the bottom edge of the container 32. A biasing means 56 such as a rubberband is wrapped around a slot 58 defined in the flange 54 and extends through or is connected at the other end to the housing 12. The biasing means 56 is of a preselected dimension and configuration so as to bias the empty container 34 to a first position, as shown in FIG. 3, whereupon the abutment member 54 abuts the inner peripheral surface of the housing 12.

The toy 10 is intended to be of a surprise or jack-in-the-box type, and to provide this action, the toy 10 includes a pop-up device, generally designated by the reference numeral 60. The device 60 includes a pop-up member 62 slidably mounted for vertical movement within the housing 46. The pop-up member 62 is of a tubular configuration and extends through an aperture 76 in the top flange 48. An interior flange 64 restricts the vertical travel by engagement with a flange 66 on the member 62. Accordingly, the pop-up member 62 may only be moved upwardly to the extent defined by the engagement of the flanges 64 and 66.

The pop-up member 62 is biased to an upward position, illustrated in FIG. 6, by a spring 68 between the flange 66 and the bottom of the housing 46. The spring 68 is held in position by a circular boss or spring retainer 70 integrally defined at the bottom of the housing 46. In its uppermost position illustrated in FIG. 6, the pop-up member 62 extends through the top 48 of the housing 12 to engage a platform generally designated by the reference numeral 72. The platform 72 includes a first attachment member 74 that is secured to the top 48 of the housing 12 and includes an aperture 77 through which the pop-up member 62 extends. The platform 72 also includes a pivotal platform 78 which is pivotally mounted to the first member 74 by a pin 80 such that the second platform member 78 is pivoted about the pin 80 upon engagement by the pop-up member 62.

The second platform member 78 includes an upstanding peg 82 on which may be positioned the figurine 14 in the manner illustrated in FIG. 4. The peg 82 extends into an aperture 84 defined in the bottom portion of the figurine 14. Upon engagement of the pop-up member 62 with the second platform member 78, it is pivoted about the pin 80 and the energy imparted to the second platform member 78 is transferred to the figurine 14 propelling it off of the peg 84 and into the surrounding body of fluid.

The pop-up member 62 is locked in a down or cocked spring compressed position (FIGS. 3 and 4) by the engagement of a first lateral extension 86 on the fluid container 32 and a second partially circular extension 88 defined on the lower end of the pop-up member 62. A second extension 88 extends through a slot 90 defined in the side of the housing 46. The first extension 86 includes a transverse partially circular arm portion 92 that engages the partially circular extension 88 in the locked or down position of the pop-up member 62 as shown in FIG. 3. To set the toy, the pop-up member 62 is pushed down into the housing 46 compressing the spring 68. As this occurs, the circular portion of the arm 88 moves in the direction of the arrow 93 and engages the arm 92 (FIG. 7). This engagement provides a camming action moving the arm 92 in the direction of the arrow 94. Thus, the container 32 is moved against the bias of this spring 56 until the extension 88 moves past the arm 92. Thereafter, the spring 56 returns the container 32 to a position whereupon the abutment member 54 abuts the inner periphery of the wall 12 of the housing 12. Once this occurs, a lower planar surface 96 of the arm 92 moves over and engages an upper planar surface 98 of the extension 88 thereby locking the pop-up member 62 in the first position.

To operate the toy 10 once the pop-up member 62 is locked in the first position, the child pours water into the trough 28 filling the container 32. Once the container 32 is filled with a predetermined amount of fluid, the weight of the accumulated water is sufficient to pivot the container 32 about the pegs 52 against the force of the spring 56. The container 32 then moves to a second stable position illustrated in FIG. 6. As this occurs, extension 92 and specifically the planar surface 96 is moved out of engagement with the planar surface 98 of the extension 88 thereby releasing the pop-up member 62. The pop-up member 62 then moves upwardly to its release position under the influence of the spring 68 engaging the second platform member 78 and pivoting it about the pin 80 to propel the figurine 14 off of the peg 84 and into the surrounding body of water. Thereafter, the child may place the figurine 14 on the peg 26 in the boat 18. To again operate the toy 10, the child simply allows the container 32 to drain whereupon the biasing means 56 returns the container 32 to its first position illustrated in FIG. 3. Thereafter, the pop-up member 62 may be pushed into the housing 46 until the arm 92 locks the extension 88 in position. Thereafter, the above described sequence can be repeated.

Many modifications and variations of the present invention are possible in light of the above teachings. Thus, it is to be understood that within the scope of the appended claims, the invention may be practiced other than specifically described above.

What is claimed and desired to be secured by Letters Patent of the United States is:

1. A fluid actuated toy, comprising:

a housing including an inlet means and outlet means for the flow of fluid;

means pivotally mounted in said housing for accumulating fluid from said inlet means;

means for biasing said accumulating means to a first preset position; and a biased member slidably mounted within said housing and engageable with said accumulating means whereby said biased member is maintained in a first position when said accumulating means is in said preset position and is moved under bias to a release position when said accumulating means is moved to a second position by the accumulation of fluid.

2. The toy of claim 1 wherein said accumulating means includes a second fluid outlet means having a flow capacity substantially smaller than said fluid inlet means.

3. The toy of claim 2 including a platform pivotally mounted on said housing and engageable by said biased member when in said release position.

4. The toy of claim 3 including a toy figure removably mounted on said platform.

5. The toy of claim 4 including flotation means removably mountable on the housing for supporting the same in a pool of fluid.

6. The toy of claim 1 wherein said latching means comprises a first semi-circular extension secured to said accumulating means and a second semi-circular protrusion secured to said biased member, said first extension being in a position when said accumulating means is in its first position to latch the biased member in said first position against the force of its biasing means.

7. A toy actuated by the accumulation of fluid to eject an object, comprising:

a first hollow housing including a fluid inlet and a fluid outlet;

a second housing mounted in said first housing;

a pop-up member slidably mounted in said second housing;

a first biasing member mounted in said second housing for biasing said pop-up member from a first position to a second position;

a fluid container pivotally mounted in said housing including an inlet in fluid communication with said inlet of said first housing and an outlet in fluid communication with said outlet of said first housing, said outlet of said container being of a smaller flow rate capacity than said inlet of said container;

a second biasing member secured to said container biasing said container to a first position;

said container being arranged to pivot from a first to a second position upon accumulation of a predetermined amount of fluid therein;

a first extension secured to said pop-up member;

a second extension secured to said container engaging said first extension in said first position of said container and said first position of said pop-up member to lock said pop-up member in said first position;

a platform pivotally mounted on said first housing engageable by said pop-up member in said second position of said pop-up member; and said object removably secured to said platform so as to eject therefrom upon engagement of said platform by said pop-up member.

8. The toy set forth in claim 7 further comprising a float removably secured to said first housing.

9. The toy set forth in claim 8 further comprising a boat for said object.

10. The toy set forth in claim 7 wherein said first and second extensions are at least partially circular to define cam surfaces.

* * * * *